US010479630B2

(12) United States Patent
Rietbergen et al.

(10) Patent No.: US 10,479,630 B2
(45) Date of Patent: Nov. 19, 2019

(54) COMPACT INTERFACE MODULE FOR A PRINTING SYSTEM

(71) Applicant: Océ Holding B.V., Venlo (NL)

(72) Inventors: Mark Rietbergen, Venlo (NL); Erik E. M. Nolting, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/032,309

(22) Filed: Jul. 11, 2018

(65) Prior Publication Data

US 2019/0023514 A1 Jan. 24, 2019

(30) Foreign Application Priority Data

Jul. 19, 2017 (EP) ..... 17182105

(51) Int. Cl.
*B65H 9/00* (2006.01)
*B65H 7/08* (2006.01)
(Continued)

(52) U.S. Cl.
CPC ..... *B65H 9/002* (2013.01); *B65H 7/08* (2013.01); *B65H 7/10* (2013.01); *B65H 9/166* (2013.01);
(Continued)

(58) Field of Classification Search
CPC ... B65H 7/02; B65H 7/06; B65H 7/08; B65H 7/10; B65H 7/14; B65H 7/20;
(Continued)

(56) References Cited

U.S. PATENT DOCUMENTS

| | | | | |
|---|---|---|---|---|
| 5,725,211 | A | 3/1998 | Blanchard et al. | |
| 6,292,650 | B1 * | 9/2001 | Akiyama | B65H 5/062 399/401 |
| 2006/0214364 | A1 * | 9/2006 | Clark | B65H 5/06 271/228 |
| 2007/0102861 | A1 * | 5/2007 | Shida | B65H 15/00 270/59 |

(Continued)

FOREIGN PATENT DOCUMENTS

| | | | |
|---|---|---|---|
| JP | 61-12556 | A | 1/1986 |
| JP | 62-269850 | A | 11/1987 |
| JP | 9-40303 | A | 2/1997 |

OTHER PUBLICATIONS

Search Report issued in European priority application 17182105.1, dated Jan. 15, 2018.

(Continued)

*Primary Examiner* — Prasad V Gokhale
(74) *Attorney, Agent, or Firm* — Birch, Stewart, Kolasch & Birch, LLP

(57) ABSTRACT

A sheet transfer device for transferring a sheet between two sheet processing devices comprising a switch for directing sheets from a first transport path coming from the first sheet processing device onto a two-way transport path or for directing sheets from the two-way transport path onto a second transport path for feeding sheets to the second sheet processing device. A transport pinch is provided along the two way transport path for reversing a sheet on the two-way transport path. When in use, the two-way transport path extends downward in a vertically extending free-hanging chamber wherein the sheet engaged by the transport pinch is allowed to hang freely under the influence of gravity. Thereby, a compact device is formed which is able to adjust the sheet to a suitable orientation for the second processing device. The device further prevents forces from the first processing device to disrupt the sheet's orientation in the second processing device.

17 Claims, 4 Drawing Sheets

(51) Int. Cl.
*B65H 7/10* (2006.01)
*B65H 9/16* (2006.01)

(52) U.S. Cl.
CPC .... *B65H 2301/323* (2013.01); *B65H 2513/40* (2013.01)

(58) Field of Classification Search
CPC ..... B65H 9/002; B65H 9/166; B65H 9/20; B65H 15/00; B65H 2301/3113; B65H 2301/3124; B65H 2301/321; B65H 2301/323; B65H 2301/331; B65H 2301/33216; B65H 2301/33312; B65H 2301/51242; B65H 2404/1315; B65H 2404/172; B65H 2404/63; B65H 2404/632; B65H 2801/24; B65H 2801/27; G03G 2215/00561; G03G 2215/007
See application file for complete search history.

(56) References Cited

U.S. PATENT DOCUMENTS

2009/0127775 A1 5/2009 Takahashi et al.
2010/0276863 A1* 11/2010 Yano ..... B65H 9/004 271/3.14
2012/0205864 A1* 8/2012 Krucinski ..... B65H 5/26 271/265.04
2015/0283842 A1* 10/2015 Tachibana ..... B42B 2/02 412/6
2016/0116881 A1* 4/2016 Kodama ..... B65H 43/00 358/498

OTHER PUBLICATIONS

European Search Report, dated Dec. 5, 2018, for European Application No. 18182773.

* cited by examiner

COMPACT INTERFACE MODULE FOR A PRINTING SYSTEM

BACKGROUND OF THE INVENTION

1. Field of the Invention

The invention relates to a sheet transfer device for transferring a sheet between two sheet processing devices, specifically from a printing system to a finishing system, and a to printing system comprising such a sheet transfer device.

2. Description of Background Art

It is known to provide a sheet transfer device or an interface module between a sheet printing system and a sheet finishing device. The finishing device receives printed sheets from the printing system and processes these into e.g. books, folders, or other print applications. The interface module connects the output of the printing system to an input of the finishing device. In practice, the sheets as output by printing system are not directly suitable for processing by the finishing device. For example, the finishing device may operate at different velocities and/or the output sheets may be mis-aligned with respect to a desired orientation for the finishing device. Additionally, the known interface modules are relatively large in order to effectively decouple the sheet in the finishing device from the printing system to prevent the printing system from pushing or pulling on the sheet during the finishing operation.

SUMMARY OF THE INVENTION

It is an object of the invention to provide a compact sheet transferring device capable of bringing the sheet into a suitable state for a finishing device.

In accordance with the present invention, a sheet transfer device according to claim 1 is provided. The sheet transfer device according to the present invention comprises:

- a switch moveable between:
  - a first position for directing sheets from a first transport path arranged for receiving sheets from a first processing device such as an image forming unit onto a two-way transport path arranged for reversing a transport direction of the sheet; and
  - a second position for directing sheets from the two-way transport path onto a second transport path arranged for feeding sheets to a second processing device such as a finishing system;
- a transport pinch actuatable in two opposing directions for reversing a transport direction of a sheet on the two-way transport path;

wherein, when in use, the two-way transport path extends downward in a vertically extending free-hanging chamber wherein the sheet engaged by the transport pinch is allowed to hang freely under the influence of gravity.

The transport pinch further comprises:

- a pair of registering wheels for contacting a first side of the sheet;
- a pair of actuators for setting an angular velocity of each registering wheel.

The first transport path receives printed sheets from the printing system. Via the switch in the first position the sheets are directed onto the two way transport path. On the two way transport path, after passing the switch and when travelling in a first direction, the sheets are engaged by the transport pinch. The transport pinch drives the sheets further onto the two way transport path. The two way transport path extends downward into the free-hanging chamber. The section of the sheet below the transport pinch thus hangs free in the free-hanging chamber. The sheet may thus be held solely by the transport pinch, which provides an effective means for decoupling the finishing device from the printing system. The transport pinch is further arranged to adjust the velocity of the sheet while engaged by the transport pinch to a suitable velocity for the finishing device. The transport pinch may further be arranged to adjust the sheet's orientation to suit the finishing device's requirements. As the sheet travels in two opposing directions on the two way transport path, the length of the two way transport path is effectively used twice. This combined with the downward direction of the two way transport in the vertical free-hanging chamber results in a compact system.

The registering wheels are spaced apart in the lateral or width direction of the two way transport path. By actuating the first registering wheel at a different angular velocity than the second registering wheel, the orientation and/or lateral position of a sheet engaged by the registering wheels is adjusted. As such, the transport pinch is configured for adjusting the velocity, orientation, and/or lateral position of the sheet to suit the finishing device. A controller may be provided to control the transport pinch to bring the sheet into a state suitable for processing by the finishing device. Such a controller may then store a reference velocity, reference orientation, and/or reference lateral position to which the state of the sheet received from the printing system is compared. The controller then controls the transport pinch such that the sheet as it moves over the second transport path is aligned to match the above references prescribed by the finishing device. The registering wheels provide a compact and simple sheet transfer device for bringing a sheet into a desired state for a finishing device or system. Thereby the object of the present invention has been achieved.

More specific optional features of the invention are indicated in the dependent claims.

It will be appreciated that the sheet transfer device according to the present invention may be applied between any two sheet processing devices, wherein the second (or downstream) sheet processing device requires an adjustment of the sheet's transport properties with respect to the first (or upstream) sheet processing device. Such sheet processing devices may for example be an image forming unit and a drying unit for drying the ink deposited on the sheet by the image forming unit. For duplex printing one-side printed sheets are first dried by the drying unit and then flipped and returned to the image forming unit for printing on the unprinted side of the sheets. By positioning the sheet transfer device according to the present invention between the drying unit and the image forming, the sheet may be flipped and suitably oriented in a single pass through the sheet transfer device. Generally speaking, the sheet transfer device according to the present invention may be positioned anywhere along the sheet transport path of the printing system, where an adjustment of the sheet's velocity or position is required. The orientation of the sheet (which side faces up) may further be controlled by adding an additional sheet flipping unit downstream of upstream of the sheet transfer device, which flipping device selectively reverses the orientation of the sheet. As such, the sheet transfer device according to the present invention may be positioned for example, between a sheet feeder and the image forming unit, between a pre-coater and the image forming unit, between the image forming unit and a sheet quality inspection device, or any other suitable combination of sheet processing devices known to the skilled person.

In a preferred embodiment, when in use, the two way transport path is positioned below the switch and at least a top portion of the two way transport path extends in the vertical direction, preferably substantially parallel thereto. A lower portion of the two way transport path may also be vertical or be curved towards the horizontal in a space efficient manner. In another preferred embodiment, the second sheet processing device is a finishing device.

In an embodiment, transport pinch further comprises:

a sensor for detecting the orientation of the sheet;

a controller for controlling the individual angular velocities of the registering wheels, such that the sheet is re-oriented with respect to the two-way transport path. The sensor is preferably a sheet orientation or position sensor positioned along the two way transport path. Such sensors are known e.g. as optical side edge detection sensors. The sensor provides state or orientation data to the controller. From the data the controller derives the velocity, orientation, and/or lateral position of the sheet. Velocity herein is preferably the speed of the sheet in the transport direction of the transport path. The orientation is preferably expressed or defined as a skew angle between the sheet, specifically an edge of the sheet and the transport direction. The lateral position is preferably the width position of a sheet or its edge. Based on the received data and its comparison to a reference state, the controller determines angular velocity profiles for both registering wheels, such that the sheet is re-oriented into the desired state.

In another embodiment, the controller is configured to control the registering wheels to adjust:

a transport velocity of the sheet in both opposing directions over the two-way transport path;

a lateral position of the sheet on the two-way transport path;

a skew angle between an edge of the sheet and a transport direction of the two-way transport path, and a spacing between two consecutive sheets on the second transport path with respect to a spacing between said sheets on the first transport path.

The transport pinch received the sheet having a first velocity from the first transport path and decelerates the sheet to a zero velocity on the two way transport path. The transport pinch then accelerates the sheet to a second velocity, which has a direction opposite to the first velocity. The switch therein directs the sheet with the second velocity to the second transport path. The transport pinch may further laterally shift the sheet on the two way transport path and rotate the sheet into alignment with e.g. the transport direction. Further, the inter-sheet spacing may be adjusted by the transport pinch. Additionally, the controller is configured to control the registering wheels to adjust or determine an arrival time of the sheet at the second transport path. The finisher may require the sheet to arrive at a predefined point at a specific time. The controller then controls the movement of the sheet through the transport pinch such that the sheet arrives at predefined point at the time prescribed by the finisher. Thereto, the controller may apply a corresponding velocity profile to the transport pinch and/or control the start/stop timing of the transport pinch. Thereby, the sheet is brought into a suitable state for processing by the finishing device.

In a further embodiment, the controller is arranged for controlling the registering wheels to:

adjust the orientation of the sheet while transporting the sheet in a first direction;

reverse the direction of the sheet from the first direction to a second direction opposite to the first direction; and adjust the orientation of the sheet while transporting the sheet in the second direction.

The transport pinch preferably adjusts the state of the sheet in both directions on the two way transport path. Thereby, the overall length of transport path required for registering the sheet is reduced.

In a preferred embodiment, the registering wheels are rotatably provided on a stationary rotation axis or shaft. Preferably each registering wheel is provided on a separate shaft or both registering wheels may be provided on a common rotation shaft. Preferably both registering wheels and their shaft(s) are positioned on one side of the two way transport path. An actuator or motor is provided for each registering wheel to rotate each registering wheel independent of the other registering wheel. A further rotation shaft is then provided for rotatably supporting support rollers or following wheels, which are passively rotatable. The sheet passes in between in the support rollers and registering wheels. Thereby, the sheet is moveably held and allowed to hang freely below the transport pinch.

In an embodiment, the transport pinch further comprises a support roller positioned opposite of the at least one of the register wheel for moveably holding the sheet between the support roller and said registering wheel, wherein each support roller is:

rotatably provided on a stationary rotation axis; and wherein each support roller is tiltable with respect to its rotation axis for adjusting a tilt angle between the rotation axis and a central axis of each support roller. During re-orientation, the sheet is skewed or rotated around an axis perpendicular to the plane of the two way transport path. It is preferred to allow free tilting of the support roller through contact with the sheet to prevent the sheet from wrinkling in between the support rollers and/or the registering wheels. Thereto, each support roller is moveable not just around its rotation axis, but also with respect thereto to for adjusting a tilt angle between the rotation axis and a central axis of a support roller. Thereby, the support rollers are tiltable independent from one another. When the controller sets the angular velocities of the registering wheels to transport and/or rotate the sheet, contact between the sheet and the support roller results in a tilting of each support roller. This results in a smooth motion of the sheet wherein deformation of the sheet is prevented.

In another embodiment, each support roller is tapered in a direction of its central axis. Along the central axis the diameter of the support roller decreases from one end to the other. This trapezoid cross-section aids in the tilting of the support roller during rotation of the sheet by the transport pinch The support roller is tapered, such that when in contact with the sheet, the contacted section of the sheet is moved laterally outwards, i.e. to nearest lateral side of the two way transport path. When applying a pair of support rollers laterally spaced apart from another, the "left" support roller drives a left side section of the sheet to the left, while the "right" support roller drives a right side section of the sheet to the right. The support rollers are preferably tapered in substantially opposite directions with respect to one another. Thereby, the sheet is spread out and tensioned in between the support rollers, preventing wrinkling of the sheet. This prevents deformation or damage to the sheet, specifically when the sheet passes through a turn after the transport pinch. One or more bends, wrinkles, or folds in the sheet add stiffness to the sheet and prevent the sheet from bending properly through the turn. The tapered support rollers allow such a turn to be positioned adjoining the transport pinch, resulting in a compact device. It will be appreciated that the tapering angle of the circumferential surface of the support roller with respect the central axis of the support roller may be small, e.g. less than 10°, 5°, 3° and/or even less than 1°. Depending on the configuration, a very small tapering angle may be sufficient to achieve the above explained stretching of the sheet between the support rollers.

In a further embodiment, the circumferential or tapered surface of the support roller extends at an angle with respect to the circumferential surface of the registering wheel. The support roller is tiltable around its rotation axis for adjusting said angle. Preferably, the support roller is tapered such that the support roller tilts in a first angular direction when the sheet travels in a first direction on the two way transport path and tilts in a second, opposite angular direction when the sheet travels in a second, opposite direction on the two way transport path. The support rollers are configured such that in both directions the support rollers force the contacting sections of the sheet in their respective laterally outward directions. Thereby, the sheet is spread or stretched regardless of its direction of travel on the two way transport path.

In an embodiment, when in use, a top portion of the two way transport path and/or free-hanging chamber extends vertically from the switch. Preferably, the transport pinch is positioned at the two-way transport path below the switch, when in use. The free-hanging chamber comprises a top portion extending vertically downwards from the switch. The top portion may be defined or formed by a housing or sheet guides which are configured to direct the sheet in a fee-hanging or non-holding manner. The top portion sheet guides preferably form a vertical transport path. The sheet guides may further define a curved portion of the free-hanging chamber, preferably a lower portion.

The curved sheet guide portion may direct the sheet downwards and sideways (i.e. horizontally) to reduce the total height of the sheet transfer device if required by the dimensions of the printing system.

In another embodiment, the first transport path comprises a downwards curve for directing a sheet downwards, when in use. The first transport path preferably comprises a substantially horizontal section, since in practice most printing systems output sheets in a horizontal orientation. The downwards curve is formed by curved sheet guides, e.g. plates or rods. The curve re-orients the horizontal sheets vertically onto the two way transport path. The curve for example extends over an angle of at least 45°, preferably 60°, very preferably 75°, and even more preferably 90°.

In an embodiment, the second transport path for transporting sheets to the finishing device comprises a curved section for returning the sheet to a substantially horizontal orientation. The second transport path may thereto comprise bent or curved sheet guides. The sheet is thus oriented in a suitable orientation for the finishing device as in practice most finishing devices are configured for horizontal input of sheets. As explained above, the tapered and tiltable support rollers allow the curved section or turn to be positioned close to or adjacent the transport pinch with the risk of damaging the sheet.

In another embodiment, the device according to the present invention further comprises:

- a first velocity sensor for sensing a first velocity of a sheet on the first transport path;
- a second velocity sensor for sensing a second velocity of a sheet on the second transport path;
- a controller for controlling the transport pinch to adjust the sheet's velocity from the first to the second velocity.

The velocity sensors may comprise one or more sheet position sensors for determining the velocity of the sheet along the transport path by detecting the passage time of a sheet at multiple positions along the transport path. The controller then controls the transport pinch to accelerate or decelerate the sheet to a velocity suitable for the finisher device.

In a further embodiment, the device according to the present invention further comprises a housing defining the free-hanging chamber, wherein, when in use, a lower end of the two-way-transport path is spaced apart from a bottom surface of the free-hanging chamber. The housing comprises side walls for forming the free-hanging chamber in combination with the bottom surface. Preferably the width, as measured in the horizontal direction along the length of the printing system, of the bottom surface is less than the vertical distance between the transport pinch and the bottom surface. Preferably, said distance is at least 20 cm, preferably 30 cm, very preferably at least 40 cm, even more preferably 50 cm. The vertical spacing between the transport pinch and the bottom surface is preferably at least a sheet length.

In a further aspect, the present invention provides a printing system comprising a sheet transfer device according to the present invention. The printing system preferably comprises an image forming unit from which sheets are directed onto the first transport path. The printing system further comprises a finishing system connected to the second transport path for receiving sheets from the sheet transfer device in a state conforming to predetermined settings or requirements of the finishing system. The finishing system prescribes sheet state requirements defining sheet parameters, such as velocity, position, sheet spacing, sheet input times, and/or orientation. The controller controls the transport pinch to output a sheet to the second transport path conforming to the sheet state requirements. The sheet is then in an optimum state for processing by the finishing system.

In another aspect, the present invention provides a method for transferring a sheet between a first and a second sheet processing device, the method comprising the steps of:

- receiving a sheet from a first sheet processing device;
- directing the sheet at a first velocity to a substantially vertically oriented transport pinch, which transport pinch comprises a pair of registering wheels for contacting a first side of the sheet and a pair of actuators for setting an angular velocity of each registering wheel;
- the transport pinch adjusting at least one of the velocity, orientation, and/or lateral position of the sheet, while the sheet is moveably held by the transport pinch and hangs freely downwards from the transport pinch;
- the transport pinch reversing the direction of movement of the sheet;
- directing the sheet from the transport pinch to the second processing device.

Preferably, the transport pinch comprises a pair of registering wheels and the step of adjusting comprises adjusting at least two or all of the velocity, orientation, sheet spacing, arrival time of the sheet at the second transport path, and/or lateral position of the sheet.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
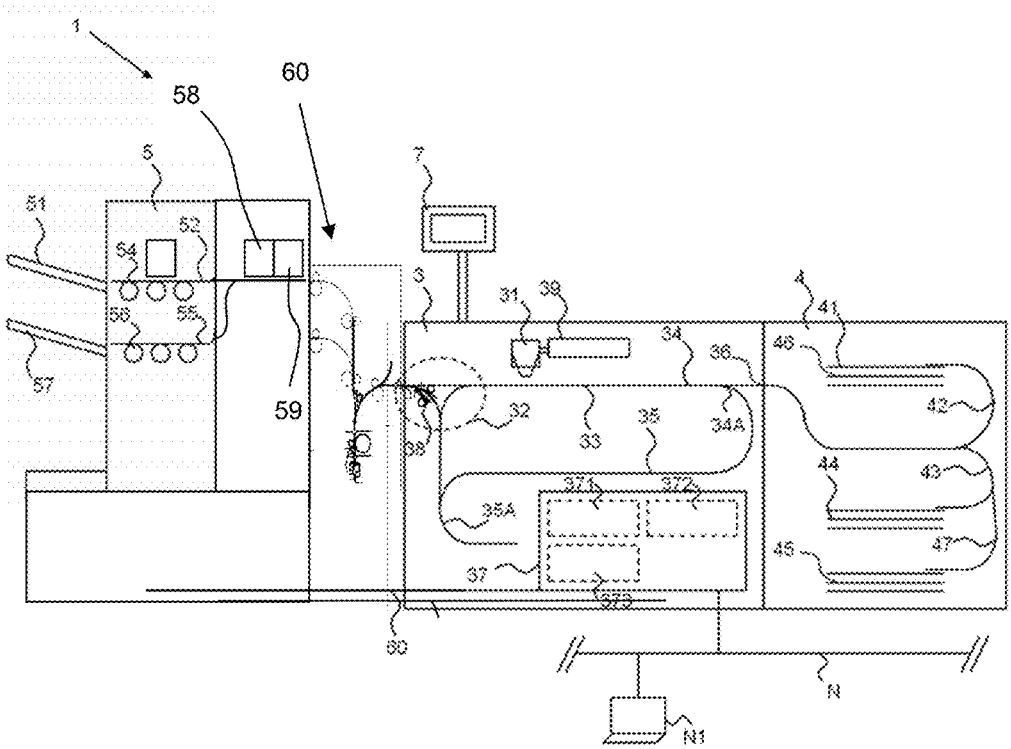
FIG. 1 is a schematic side view of a printing system according to the present invention.

The present invention will now be described with reference to the accompanying drawings, wherein the same reference numerals have been used to identify the same or similar elements throughout the several views.

FIG. 1 shows schematically an embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet print system, an electrographic print system, etc.

The output section 5 comprises a first output holder 52 for holding printed image receiving material, for example a plurality of sheets. The output section 5 may comprise a second output holder 55. While 2 output holders are illustrated in FIG. 1, the number of output holders may include one, two, three or more output holders. The printed image receiving material is transported from the print engine and control section 3 via an inlet 53 to the output section 5. When a stack ejection command is invoked by the controller 37 for the first output holder 52, first guiding means 54 are activated in order to eject the plurality of sheets in the first output holder 52 outwards to a first external output holder 51. When a stack ejection command is invoked by the controller 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a controller 37 for controlling the printing process and scheduling the plurality of sheets in a printing order before they are separated from input holder 44, 45, 46.

The controller 37 is a computer, a server or a workstation, connected to the print engine and connected to the digital environment of the printing system, for example a network N for transmitting a submitted print job to the printing system 1. In FIG. 1 the controller 37 is positioned inside the print engine and control section 3, but the controller 37 may also be at least partially positioned outside the print engine and control section 3 in connection with the network N in a workstation N1.

The controller 37 comprises a print job receiving section 371 permitting a user to submit a print job to the printing system 1, the print job comprising image data to be printed and a plurality of print job settings. The controller 37 comprises a print job queue section 372 comprising a print job queue for print jobs submitted to the printing system 1 and scheduled to be printed. The controller 37 comprises a sheet scheduling section 373 for determining for each of the plurality of sheets of the print jobs in the print job queue an entrance time in the paper path of the print engine and control section 3, especially an entrance time for the first pass and an entrance time for the second pass in the loop in the paper path according to the present invention. The sheet scheduling section 373 will also be called scheduler 373 hereinafter.

The sheet scheduling section 373 takes the length of the loop into account. The length of the loop corresponds to a loop time duration of a sheet going through the loop dependent on the velocity of the sheets in the loop. The loop time duration may vary per kind of sheet, i.e. a sheet with different media properties.

Resources may be recording material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode and partially in a duplex mode.

The print head or print assembly 31 is suitable for ejecting and/or fixing marking material to image receiving material. The print head or print assembly 31 is positioned near the paper path section 34. The print head or print assembly 31 may be an inkjet print head, a direct imaging toner assembly or an indirect imaging toner assembly.

While an image receiving material is transported along the paper path section 34 in a first pass in the loop, the image receiving material receives the marking material through the print head or print assembly 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop. The sheets coming from the paper path section 35 are starting their second pass along the print head or print assembly 31 in the loop. When a sheet has passed the print head or print assembly 31 for the second time in the second pass, the sheet is transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties. While 3 input holders are illustrated in FIG. 1, the number of input holders may include one, two, three or more input holders.

The local user interface 7 is suitable for displaying user interface windows for controlling the print job queue residing in the controller 37. In another embodiment a computer N1 in the network N has a user interface for displaying and controlling the print job queue of the printing system 1.

The output section 5 comprises a finisher system 58, 59 with one or more finishers 58, 59 for performing a finishing operation on a printed sheet. The finishers 58, 59 may for example comprise a folder, stapler, binder, coater, etc, wherein the printed sheets may be processed for forming folders, booklets, etc. Generally, the finishers 58, 59 operate at a specific or predetermined processing speed, which is different from the processing speed of the image forming unit 39. A sheet extending into the finisher 58, 59 may experience a force difference when the finisher 58, 59 starts processing a leading section of the sheet while a trailing section of said sheet is still being processed or transported by the transport path sections 32, 33, 34, 35 of the printing system 1. This could result in damage to the sheet or errors in the finishing operations. In order to decouple the transport path sections 32, 33, 34, 35 from the finishers 58, 59, the printing system 1 comprises a sheet transfer device 60 or interface module 60 between the image forming unit 39 and the finishers 58, 59. The finishing system 58, 59 outputs the finished sheet product to a designated one of the output trays 51, 57.

Figure 2:
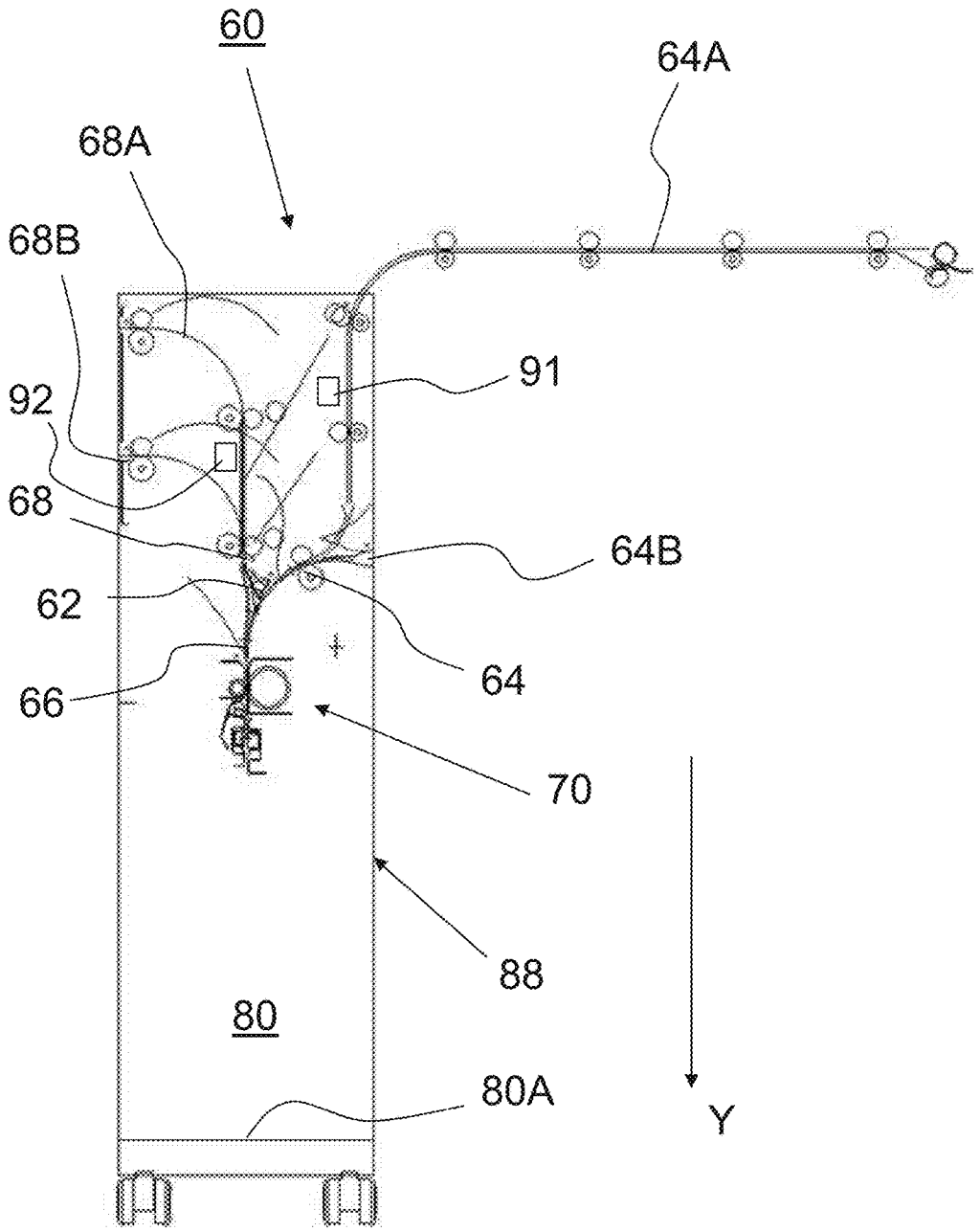
FIG. 2 is a schematic side view the sheet transfer device of the printing system in FIG. 1.

FIG. 2 illustrates in more detail the sheet transfer device 60. The sheet transfer device 60 comprises a Y-shaped intersection of three transport paths 64, 66, 68. The first transport path 64 receives sheets from the transport path sections 34, 38. In the embodiment shown in FIG. 2, the first transport path 64 comprises an intersection, where a first sheet feeding path 64A comes together with a second sheet feeding path 64B. The different feeding paths 64A, 64B allow insertion of sheets into the sheet transfer device 60 from different sections of the printing system 1 as well the insertion of additional sheets into a stream of printed sheets coming from the image forming unit 39.

A switch 62 is positioned at the intersection. In a first position (P1 in FIG. 3) the switch 62 directs sheets from the first transport path 64 to a two-way transport path 66. The two way transport path 66 comprises a transport pinch 70 which first transports the sheet in a first, downward direction on the two way transport path 66 until a trailing edge of the sheet passes the switch 62. The controller 37 then reverses the direction of motion of the sheet on the two way transport path 66, such that the sheet moves in the opposite direction with respect to the direction the sheet entered the two way transport path 66. The switch 62 is flipped into its second position (P2 in FIG. 3) before the present leading edge of the sheet arrives at the switch 62. The switch 62 may be a passive switch 62 actuated by sheet contact or an active switch driven by the controller 37. The switch 62 in the second position P2 then directs the sheet from the two way transport path 66 to the second transport path 68, which directs the sheet to a finisher 58, 59. In the embodiment in FIG. 2, the second or finishing transport path 68 diverges into multiple output transport paths 68A, 68B for directing finished sheet products to one of different output trays 53, 57.

The two way transport path 66 is open ended at its lower end, when viewed in the direction Y of gravity. Below the transport pinch 70 extends a free-hanging chamber 80 defined by a housing 88. The two way transport path 66 has a finite length, such that a lower section of the sheet when engaged by the transport pinch 70 hangs freely in the free-hanging chamber 70. The bottom 80A of the free-hanging chamber 80 is thus vertically spaced apart from the transport pinch 70 by a distance of over at least half, preferably three-quarters, very preferably a whole of the sheet's length. The distance between the transport pinch 70 and the bottom surface 80A exceeds the distance between the switch 62 and the transport pinch 70, preferably by at least a factor of two, very preferably three, even more preferably four. The free-hanging chamber 80 is formed by a bottom wall 80A and side walls. The side walls are horizontally spaced apart from the sheet as it hangs from the transport pinch to allow the sheet to hang freely. Freely implies herein that the section of the sheet below the transport pinch is unrestricted 70 and preferably experiences only the force of gravity. Sheet guides may be provided to form a sheet passage, but below the transport pinch 70 the sheet is preferably free from holding forces. The sheet guides preferably form a vertically extending top portion or path for the sheet on the two way transport path 66. Further sheet guides may curve a lower portion of said path, such that the sheet bends sideways towards the horizontal in the lower portion of the free-hanging chamber. The height of the free-hanging chamber 80 is preferably sufficient to prevent contact between the sheet and the bottom surface 80A at all times, though a curved sheet guide may be provided to direct a bottom end of a long sheet away from the bottom surface 80A.

It will be appreciated that the sheet transfer device 60 is arranged for flipping the sheet similar to the paper path section 35A. In case the finisher 38, 39 prescribes or requires a specific orientation of the printed sheet, the controller 37 can determine the orientation of the sheet by setting the order wherein the front and back images are printed by the image forming unit 39, by selectively flipping the sheet in or bypassing the paper path section 35A, and/or by flipping the sheet in the sheet transfer device 60. Basically, the controller 37 is configured to control progress of the sheet through the printing system 1, such that the sheet is output by the sheet transfer device 60 with a specific side orientated in compliance with an orientation prescribed by the finisher 38, 39.

First and second sheet velocity sensors 91, 92 are respectively provided on the first and second transport paths 64, 68. The sheet velocity sensors 91, 92 may comprise an optical detector to detect the sheet velocity, such as an array of LED-detector pairs spaced apart along the respective transport direction. Alternatively, the sheet velocity sensors 91, 92 may comprise a roller, wherein the angular of the roller when in contact with the sheet provides a measure for the sheet's velocity. Other suitable sheet velocity sensors known to the skilled person may be applied.

Figure 3:
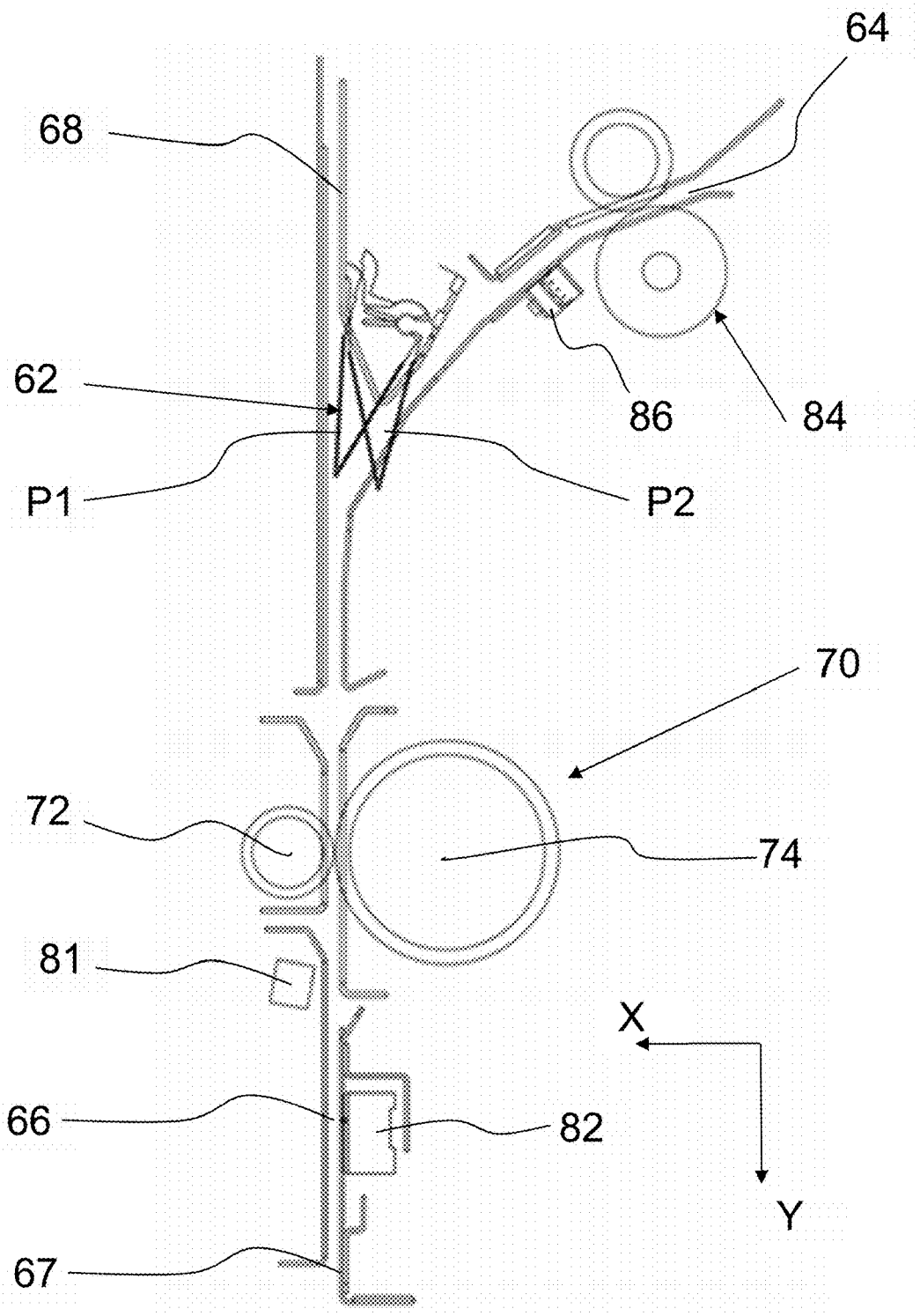
FIG. 3 is an enlarged schematic side view the sheet transfer device in FIG. 2.

FIG. 3 illustrates in more details the sheet transfer device 60. The first transport path 64 for receiving sheets from the printing system 1 is formed by sheet guides 64A and further comprises a feed transport pinch 84 for transporting sheets to the switch 62 and into the two way transport path 66. The first transport path 64 further comprises a sheet detector 86 positioned along the first transport path 64 upstream of the switch 62. The sheet detector 86 is arranged to detect a passage of a leading or trailing edge of the sheet along the sheet detector 86. The controller 37 can derive a time for reversing the movement of the sheet on the two way transport path 66 from the signal from the sheet detector 86 along with sheet velocity information as used e.g. for controlling the speed of the feed transport pinch 84 or the transport pinch 70. The sheet enters on the first transport path 64 at a first velocity. The controller 37 controls the transport pinch 70 to adjust the sheet's velocity from the first to a second velocity to match a predefined velocity of the finisher. The predefined velocity is prescribed by the finisher 58, 59 as a job setting to which the state of the incoming sheets on the first transport path 64 is compared.

The switch 62 in the first position P1 transports the sheet to the transport pinch 70, which comprises registering wheels 74 or rollers 74 for contacting a first side of the sheet. In the transport pinch 70, the sheet is engaged on opposite sides by the registering wheels 74 and the support roller(s) 72. The registering wheels 74 are driveable by a pair of actuators 79, 79' independently from one another. By rotating a first registering wheel 74 at a different angular velocity than a second registering wheel 74, the orientation and/or lateral position of a sheet in the transport pinch 70 may be adjusted. The sheet may thereby be corrected for skewing with respect to the transport direction of the transport path 66 and/or shifted laterally in a direction perpendicular to the transport path 66.

The orientation of the sheet of the sheet on the two way transport path 66 is determined by the sensors 81, 82. The sensor 81, 82 comprises an orientation sensor for determining a skew angle of the sheet with respect to a transport direction of the two way transport path 66 or the vertical direction Y. The sensor 81, 82 comprises a lateral position sensor for determining the lateral position of the sheet on the two way transport path 66. In an embodiment, the sensors 81, 82 comprise a side edge detection sensor for determining the position of a point on a lateral edge of the sheet. The orientation and/or position data is transmitted to the controller 37, which compares the data to a reference orientation to determine whether a state correction is required. If so, the controller 37 controls the pair of independently driveable registering wheels 74 to adjust the sheet's position and/or orientation. Thereby, the sheet is aligned in a desired position for the finishers 58, 59.

The orientation and/or position correction is performed as the sheet is moveably held only by the transport pinch 70. The sheet is allowed to extend into the free-hanging chamber 80 below the transport pinch 70. The sheet guides 67 forming the two way transport path 66 comprise a length significantly shorter than the height of the free-hanging chamber 80. The adjustment of the sheet's orientation and/or lateral position may be done on its downward and/or upward pass over the two way transport path 66. A compact device 60 is achieved by allowing the adjustment to be performed on the first and on the reversed pass of the sheet. The re-oriented sheet is then passed via the switch 62 in the second position P2 to second transport path 68, which extends vertically above the two way transport path 66.

The transport pinch 70 is configured to bring the sheet into a suitable state for the finisher 58, 59. Aside from the above mentioned correction of the sheet's angular and/or lateral orientation, the controller 37 may instruct the transport pinch 70 to adjust the sheet's velocity in accordance with a predefined finisher sheet velocity setting. The controller 37 may further control the timing at which sheets arrive at the finisher 58, 59. Additionally, the controller 37 may adjust the inter-sheet spacing to a spacing suitable to the finisher 58, 59. Should the finisher 58, 59 require a specific front side up or down orientation of the sheet, the controller 37 controls the printing system 1 including the transport pinch 70 to orient the sheet with the prescribed side facing in accordance with requirements of the finisher 58, 59.

Figure 4:
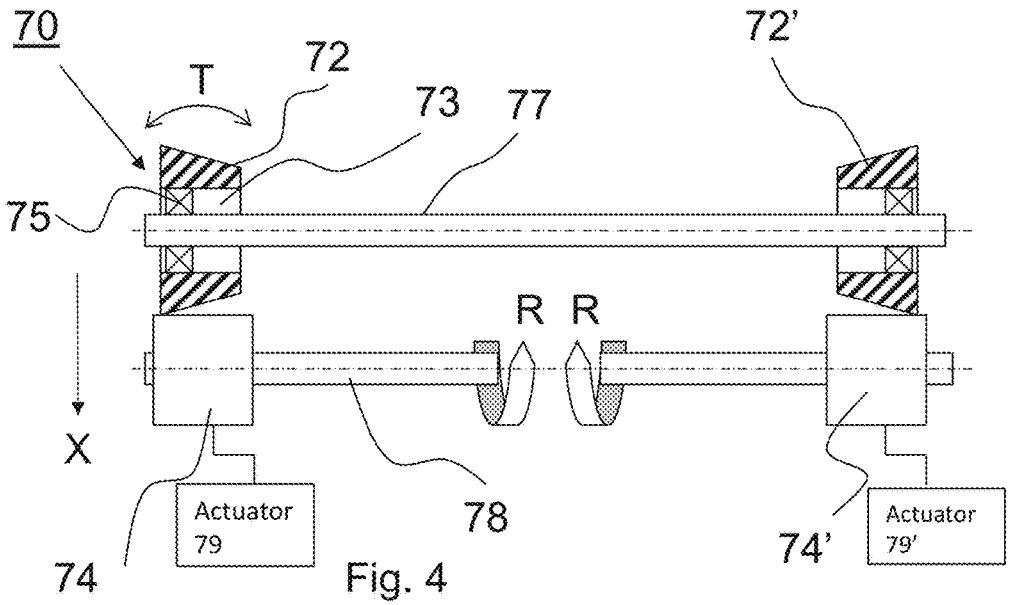
FIG. 4 is a schematic vertical top view the transport pinch of the sheet transfer device in FIGS. 2 and 3.

FIG. 4 shows a schematic horizontal cross-section of a support roller 72. The support roller 72 is rotatable provided around a rotation axis 77. Each registering wheel 74 is rotatably provided on its own further rotation axis 78. The two way transport path 66 extends in between the rotation axes 77, 78. Preferably the support roller 72 is freely rotatable, while each registering wheel 74 is rotated by its own actuator. When viewed along the rotation axis 77, the support roller 72 is tapered, while the registering wheel 74 is substantially straight or even. The circumference or diameter of one side of the support roller 72 is substantially larger or exceeds the circumference of the opposite side of the support roller 72. The support roller 72 is further tiltable around a tilting axis perpendicular to the rotation axis 77 over a limited angular range, as indicated by tilting arrow T. Thereby, a tilting angle θ between the circumferential surface of the support roller 72 and the rotation axis 77 may be adjusted. The support roller 72 is freely tiltable such that the orientation of the support roller 72 changes due to contact with the sheet. The support roller 72 is tapered such that the section of the sheet in contact with said support roller 72 is urged sideways. The left support roller 72 is configured to force a portion of the sheet to the left, while the right support roller 72' forces a right hand section of the sheet to the right side of the transport path. Thereby, the sheet is stretched in between the support rollers 72, 72'. As such bends, wrinkles, or folds in the sheet may be eliminated, resulting in a substantially planar or flat sheet. This flatness allows the sheet to be bent when moving through a turn in the second transport path 68 closely downstream of the transport pinch 70. This prevents deforming or tearing of the sheet. The directions left and right are herein defined as the lateral directions on the plane of the two way transport path 66 when viewed along the transport direction of the sheet.

The support roller 72 comprises cylindrical bore 73 parallel to and centered around its central axis. The bore's diameter 73 is larger than the diameter of the rotation shaft 77 forming the rotation axis 77. A tubular space or chamber is thereby provided between the rotation shaft 77 and the support roller 72. The support roller 72 is connected to the rotation shaft 77 by a bearing 75. The bearing is configured to provide sufficient flexibility to allow the support roller 72 to adjust its tilt angle θ with respect to the rotation axis 77. The bearing 77 may be a flexible bearing, deformable connection, flexible coupling, or a flexure bearing.

Figure 5:
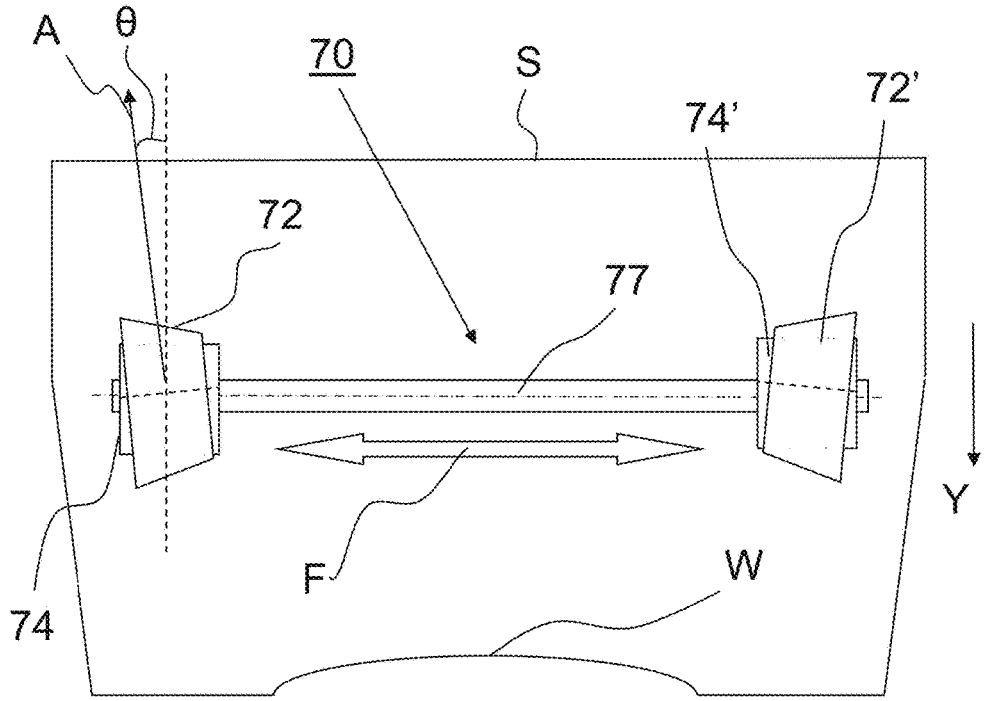
FIG. 5 is a schematic horizontal side view the transport pinch of the sheet transfer device in FIGS. 2-4.

FIG. 5 illustrates the tilting of the support roller 72 around a tilting axis perpendicular to the plane of the two way transport path 66. The support roller 72 tilts around a horizontal tilt axis, thereby positioning the support roller 72 at a tilting angle θ with respect to the vertical direction Y. The arrow A indicates the direction A of the forces exerted on the sheet by the titled support roller 72 within the transport pinch 70. The direction A is determined by the tapering of the support roller 72. The force exerted by the support roller 72 comprises a laterally outward component towards the nearest edge of the two way transport path 66. The portion of the sheet S in contact with the support roller 72 experiences a force with a component in the lateral direction of the two way transport path 66. The support roller 72 thereby urges the portion of the sheet S to the side adjacent the respective support roller 72. The second support roller 72' acts similarly and is configured to exert a laterally opposing force. The two support rollers 72, 72' are configured to exert opposing lateral forces F on the sheet S such that the sheet S in between the two support rollers 72, 72' is stretched, as indicated by the arrow F. The lateral force is directed towards the edge of the two-way transport path 66 closest to the respective support roller 72, 72'. The flexible bearing 75 within the bore 73 allows the support roller 72 to tilt freely to orientate itself in the direction A, thereby exerting both a lateral force for stretching the sheet and a longitudinal force in the transport direction for engagement of the sheet by the registering wheel. This stretching prevents deformation of the sheet S, specifically wrinkling of the sheet S in between neighboring support wheels 72, 72'. A wrinkle W on the sheet S is removed by the stretching action as indicated in FIG. 5. The sheet S initially comprises a wrinkle W over its full length in the transport direction. However, due to the stretching force F exerted by the support rollers 72, 72' the wrinkle W is smoothened out above the transport pinch 70, as the lateral edges of the sheet S are pulled to the lateral sides by the transport pinch 70. By passing through the transport pinch 70, the sheet S is flattened, giving the sheet S sufficient flexibility to pass through a turn 68A positioned in close proximity to the transport pinch 70. As such a very compact interface module 60 between a printing system 1 and a finisher system 58, 59 is provided.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet transfer device for transferring a sheet from a first sheet processing device to a second sheet processing device, the sheet transfer device comprising:

a switch moveable between:

a first position for directing sheets from a first transport path arranged for receiving sheets from the first sheet processing device onto a two-way transport path arranged for reversing a transport direction of the sheet; and a second position for directing sheets from the two-way transport path onto a second transport path arranged for feeding sheets to the second sheet processing device;

a transport pinch actuatable in two opposing directions for reversing a transport direction of a sheet on the two-way transport path;

when in use, the two-way transport path extends downward in a vertically extending free-hanging chamber wherein the sheet engaged by the transport pinch is allowed to hang freely under the influence of gravity, wherein:

the transport pinch comprises:

a pair of registering wheels for contacting a first side of the sheet;

a pair of actuators for setting an angular velocity of each registering wheel.

2. The device according to claim 1, wherein the second sheet processing device is a finishing device.

3. The device according to claim 2, wherein the controller is configured to control the registering wheels to adjust:

a transport velocity of the sheet in both opposing directions over the two-way transport path;

a lateral position of the sheet on the two-way transport path; and a skew angle between an edge of the sheet and a transport direction of the two-way transport path.

4. The device according to claim 1, wherein the transport pinch further comprises:

a sensor for detecting at least one of an orientation of the sheet and a lateral position of the sheet;

a controller for controlling the individual angular velocities of the registering wheels, such that the sheet is re-oriented with respect to the two-way transport path.

5. The device according to claim 1, wherein the controller is arranged for controlling the registering wheels to:

adjust the orientation of the sheet while transporting the sheet in a first direction;

reverse the direction of the sheet from the first direction to a second direction opposite to the first direction; and adjust the orientation of the sheet while transporting the sheet in the second direction.

6. The device according to claim 1, wherein the transport pinch further comprises a support roller positioned opposite of at least one of the register wheel for moveably holding the sheet between the support roller and said registering wheel, wherein each support roller is:

provided on a stationary rotation axis; and wherein each support roller is tiltable with respect to its rotation axis for adjusting a tilt angle between the rotation axis and a central axis of each support roller.

7. The device according to claim 6, wherein each support roller is tapered in a direction of its central axis.

8. The device according to claim 7, wherein the circumferential surface of said support roller extends at an angle with respect to the circumferential surface of the registering wheel, and wherein the support roller is tiltable around its rotation axis for adjusting said angle.

9. The device according to claim 1, wherein, when in use, a top portion of the free-hanging chamber extends vertically from the switch.

10. The device according to claim 1, wherein the transport pinch is positioned at the two-way transport path below the switch, when in use.

11. The device according to claim 1, wherein the first transport path comprises a downwards curve for directing a sheet downwards, when in use.

12. The device according to claim 1, further comprising:

a first velocity sensor for sensing a first velocity of a sheet on the first transport path;

a second velocity sensor for sensing a second velocity of a sheet on the second transport path;

a controller for controlling the transport pinch to adjust the sheet's velocity from the first to the second velocity.

13. The device according to claim 1, further comprising a housing defining the free-hanging chamber, wherein, when in use, a lower end of the two-way-transport path is spaced apart from a bottom surface of the free-hanging chamber.

14. A printing system comprising a sheet transfer device according to claim 1.

15. The device according to claim 1, wherein the switch is over the two-way transport path, when in use.

16. A method for transferring a sheet between a first and a second sheet processing device, the method comprising the steps of:

receiving a sheet from a first sheet processing device;

directing the sheet at a first velocity to a substantially vertically oriented transport pinch, which transport pinch comprises a pair of registering wheels for contacting a first side of the sheet and a pair of actuators for setting an angular velocity of each registering wheel;

the transport pinch adjusting at least one of the velocity, orientation, and lateral position of the sheet, while the sheet is moveably held by the transport pinch and hangs free below the transport pinch;

the transport pinch reversing the direction of movement of the sheet;

directing the sheet from the transport pinch to the second processing device.

17. The method according to claim 16, further comprising operating a switch to move between a first position for directing sheets from the first sheet processing device onto a two-way transport path arranged for reversing a transport direction of the sheet, and a second position for directing sheets from the two-way transport path to the second sheet processing device, wherein the switch is over the two-way transport path, when in use.

* * * * *